US006723212B1

(12) United States Patent
Paulus et al.

(10) Patent No.: US 6,723,212 B1
(45) Date of Patent: Apr. 20, 2004

(54) IMPREGNATED GRAPHITE CATHODE FOR THE ELECTROLYSIS OF ALUMINIUM

(75) Inventors: Regis Paulus, Vourles (FR); Jean-Michel Dreyfus, Lyons (FR)

(73) Assignee: Carbone Savoie, Venissieux (FR)

( * ) Notice: Subject to any disclaimer, the term of this patent is extended or adjusted under 35 U.S.C. 154(b) by 0 days.

(21) Appl. No.: 09/890,607

(22) PCT Filed: Feb. 1, 2000

(86) PCT No.: PCT/FR00/00233

§ 371 (c)(1), (2), (4) Date: Nov. 19, 2001

(87) PCT Pub. No.: WO00/46427

PCT Pub. Date: Aug. 10, 2000

(30) Foreign Application Priority Data

Feb. 2, 1999 (FR) ..... 99 01322

(51) Int. Cl.[7] ..... C25B 11/12

(52) U.S. Cl. ..... 204/294; 204/243.1; 205/380; 205/386

(58) Field of Search ..... 204/294, 243.1; 205/380, 386

(56) References Cited

U.S. PATENT DOCUMENTS

| | | | | |
|---|---|---|---|---|
| 3,616,045 A | | 10/1971 | Kosar et al. | 156/326 |
| 4,589,967 A | | 5/1986 | Etzel | 204/243 R |
| 5,501,729 A | * | 3/1996 | Lewis et al. | 106/274 |
| 5,607,770 A | * | 3/1997 | Lewis et al. | 204/294 |

FOREIGN PATENT DOCUMENTS

| | | |
|---|---|---|
| EP | 0 132 647 | 7/1984 |
| EP | 0 562 591 A1 | 9/1993 |
| JP | B2 54-27313 | 9/1979 |
| JP | A 2-283677 | 11/1990 |

OTHER PUBLICATIONS

Book of Winnacker—Küchler Chemische Technologie Kohlenstoff Produkte, pp. 278–303 **.

Carbone Savoie Product Information, "Aluminium Cell Linings—Bottom Blocks", Sep. 1990.

SGL Carbon Group, "Aluminium Electrolysis Cell" **.

Kozar, Laszlo et al., "Improvement of the properties of carbon blocks by impregnation, especially for use as aluminum cell Cathodes" XP002117128 (abstract only).

* cited by examiner

*Primary Examiner*—Bruce F. Bell

(57) ABSTRACT

This cathode (3) contains, within the pores in its structure, a carbon-containing product fired at a temperature of less than 1600° C., improving the erosion resistance by protecting the graphitized binder.

44 Claims, 1 Drawing Sheet

IMPREGNATED GRAPHITE CATHODE FOR THE ELECTROLYSIS OF ALUMINIUM

The subject of the present invention is a graphite cathode for the electrolysis of aluminium.

BACKGROUND OF THE INVENTION

In the electrolytic process used in most aluminium production plants, an electrolysis pot comprises, in a metal box jacketed with refractories, a cathode sole composed of several juxtaposed cathode blocks. This assembly constitutes the crucible which, rendered sealed by a fireproof-lining slurry, is the seat of the transformation, under the action of the electric current, from electrolytic solution into aluminium. This reaction takes place at a temperature generally greater than 950° C. In order to withstand the thermal and chemical conditions prevailing during the operation of the pot and to satisfy the need to conduct the elecrolysis current, the cathode block is manufactured from carbon-containing materials. These materials range from semi-graphite to graphite. They are formed by extrusion or by vibrocompaction after mixing the raw materials:

- either a mixture of pitch, calcined anthracite and/or graphite in the case of semi-graphitic and graphitic materials. These materials are then fired at approximately 1200° C. The graphitic cathode contains no anthracite. The cathode manufactured from these materials is commonly called "carbon cathode".
- or a mixture of pitch and coke, with or without graphite in the case of graphites. In this case, the materials are fired at approximately 800° C. and then graphitized at above 2400° C. This cathode is called a "graphite cathode".

It is known to use carbon cathodes which, however, have moderate electrical and thermal properties, no longer suitable for the operating conditions in modern pots, especially a high current intensity. The need to reduce energy consumption and the possibility of increasing the intensity of the current, especially in existing potlines, has prompted the use of graphite cathodes.

The graphitization treatment for graphite cathodes, at above 2400° C., allows the electrical and thermal conductivities to be increased, thus creating the conditions sufficient for optimized operation of an electrolysis pot. The energy consumption decreases because of the drop in electrical resistance of the cathode. Another way of benefiting from this drop in electrical resistance consists in increasing the intensity of the current injected into the pot, thus making it possible to increase the production of aluminium. The high value of the thermal conductivity of the cathode then allows the excess heat generated by the increased current to be removed. In addition, graphite-cathode pots appear to be electrically less unstable, that is to say having less fluctuation in electric potentials than carbon-cathode pots.

However, it has turned out that pots equipped with graphite cathodes have a shorter lifetime than pots equipped with carbon cathodes. Graphite-cathode pots become unusable by the aluminium being excessively enriched with iron, which results from the cathode bar being corroded by the aluminium. The metal reaches the bar as a result of erosion of the graphite block. Although erosion of carbon cathodes has also been observed, it is much less and does not impair the lifetime of the pots, which become unusable for reasons other than erosion of the cathode.

By contrast, the wear of graphite cathodes is sufficiently rapid to become the prime cause of death of aluminium electrolysis pots at an age that might be termed premature compared with the lifetimes recorded in the case of pots equipped with graphitic cathodes. Thus, the following wear rates of the various materials have been recorded:

| Cathode | Wear rate (mm/year) |
|---|---|
| semi-graphitic carbon | 10–20 |
| graphitic carbon | 20–40 |
| graphite | 40–80. |

FIG. 1 of the appended schematic drawing shows a cathode block 3, with the cathode current-supply bars 2, the initial profile of which is denoted by the reference 4. The erosion profile 5, depicted in dotted lines, shows that this erosion is accentuated at the ends of the cathode block.

The erosion rate of a graphite cathode block is consequently its weak point and its economic attraction in terms of increased production may disappear if the lifetime cannot be increased.

Although starting from different raw materials, carbon cathodes and graphite cathodes consist, in the end-product, of solid graphite grains and essentially differ in terms of the heat treatment given to the binder. The pitch of the graphitic product is treated, during firing of the product, at a temperature close to 1200° C. The binder of the graphite cathode is heated, during graphitization, to a temperature above 2400° C. and is therefore transformed into graphite.

The porosity of carbon and graphite cathodes results from the coking of the binder. However, this porosity is invaded, during operation of the pots by the electrolysis products, mainly sodium and aluminium fluorides. These products are therefore in contact with the carbon or the graphite coming from the binder.

The document Chemical Abstract Vol. 73, No. 22 teaches the impregnation of cathodes in order to block the pores and prevent the penetration of reactive products. This impregnation is done with products other than pitch and tar which, according to the author, are not effective as they do not wet the carbon enough.

The document JP 02 283 677 relates to electrodes for electrical discharge machining. The electrodes are impregnated and annealed before undergoing a graphitization heat treatment at 2600–3000° C.

The document EP 0 562 591 relates to a method of impregnating carbon and graphite blocks at room temperature, using pitches treated with resins in order to obtain impregnation yields of greater than 40% after the impregnant has been carbonized. This document pertains neither to the electrolysis of aluminium nor the problem of the erosion of graphite cathodes.

The document JP 54 027 313 relates to an electrode impregnated with resins, for the production of chlorine.

SUMMARY OF THE INVENTION

The object of the invention is to provide a graphite cathode whose lifetime is increased. For this purpose, this cathode contains, within the pores of its structure, a carbon-containing product fired at a temperature of less than 1600° C., improving the erosion resistance by protecting the graphitized binder.

The carbon-containing product is introduced by impregnating it into a graphite cathode obtained in a known manner.

The carbon-containing product fired at a temperature of less than 1600° C. ensures, within the pores in the cathode, that the graphitized binder is protected and improves the erosion resistance of the cathode. This product is deposited on the graphitized binder, lining the pores, without blocking the pores which are necessary for the flow of products coming from the electrolysis bath. By being interposed between the products from the bath and the graphite binder, the impregnation product prevents the latter from being degraded by the reaction with the components from the bath which migrate into the pores of the cathode. Owing to its heat treatment at low temperature, compared with a graphite, the impregnation product is more resistant to attack by the components from the bath.

The carbon-containing product protecting the graphitized binder is chosen from coal pitches and petroleum pitches.

According to one method of implementation, the process for obtaining such a cathode consists in injecting the carbon-containing product in liquid form into the pores, protecting the graphitized binder. By way of example, if the carbon-containing impregnation product is a coal pitch, this is heated to a temperature of about 200° C. in order to obtain a satisfactory viscosity.

One process for producing the cathode according to the invention consists firstly, in a manner known per se, in producing a cathode from coke, with or without graphite, and from pitch subjected to a heat treatment at a temperature greater than 2400° C., in placing this cathode in an autoclave after optionally preheating it to a temperature corresponding to the temperature at which the impregnation product has the desired viscosity, in creating a vacuum in the autoclave, in introducing the impregnation product in liquid form into the autoclave, until the cathode is completely immersed, in breaking the vacuum in the autoclave by injecting a pressurized gas in order to allow, depending on the duration of the treatment, partial or complete filling of the pores in the cathode with the impregnation product, in returning the autoclave to atmospheric pressure, in removing the cathode from the autoclave and, finally, after possible cooling, in carrying out a heat treatment at a temperature of less than 1600° C., but sufficient for the impregnation product to undergo curing and/or coking, thus forming a non-graphitized carbon layer which protects the graphitized binder from erosion.

The purpose of the heat treatment carried out after impregnation is to stabilize the impregnation product. This may be necessary in specialized potlines or during preheating of the electrolysis pot and during operation of the latter.

It may be noted that the impregnation may be carried out over the entire cathode, or only over part of it. When only partial impregnation is desired, it is necessary to render impermeable the surface of the block to be treated, or else to immerse the block only partially in the impregnation liquid.

In order to enhance the action of the treatment, it is possible to carry out, if so desired, several successive impregnation and firing cycles.

BRIEF DESCRIPTION OF THE DRAWINGS

In any event, the invention will be more clearly understood with the aid of the description which follows, with reference to the appended schematic drawing representing, by way of non-limiting example, a graphite cathode and an apparatus for impregnating a cathode, in which.

DETAIL DESCRIPTION OF THE INVENTION

Figure 1:
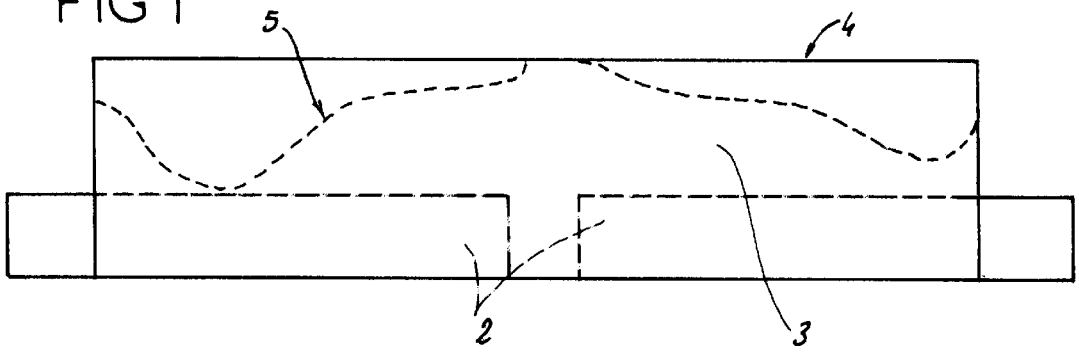
FIG. 1 is a schematic view of a cathode.

FIG. 1 was described earlier for showing the erosion profile of a graphite cathode after a certain operating time.

Figure 2:
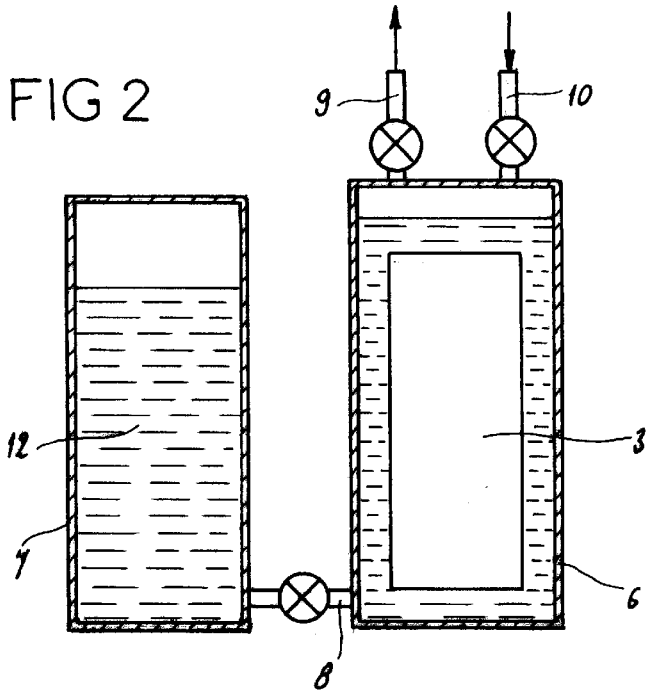
FIG. 2 is a view of an apparatus for impregnating a cathode with a carbon-containing product.

FIG. 2 shows an impregnation apparatus comprising an autoclave 6 intended to house a graphite cathode 3. This autoclave 6 may be connected to a tank 7 for storing the carbon-containing impregnation product, via a line 8, as well as to a vacuum source, via a line 9, and to a pressurized-gas source, via a line 10.

After having conventionally obtained a graphite block intended to form a cathode, with a graphitization operation at a temperature greater than 2400° C., this cathode block 3 is placed in the autoclave 6. The carbon-containing product 12 is stored in the tank 7 and optionally heated in order to be in a liquid state with a viscosity ensuring that it penetrates into the pores of the cathode easily. The graphite block 3 and the autoclave are heated to the same temperature.

The vacuum is created in the autoclave 6 by opening the line 9.

While keeping the autoclave under vacuum, the carbon-containing product 12 is introduced into the autoclave 6 until the graphite block 3 is completely immersed. Since the line 8 is then closed, the vacuum is broken by injecting a pressurized gas via the line 10. Under the action of the hydrostatic pressure thus created, the impregnant penetrates into the pores in the product. The duration of the treatment is calculated to allow complete or partial invasion of the pores in the product.

Finally, the pressure is returned to atmospheric pressure and the graphite block 3 is removed from the autoclave and, if necessary, cooled. The graphite block may then be subjected to a heat-treatment operation at a temperature of less than 1600° C., this heat treatment depending on the nature of the carbon-containing product 12.

An example of graphite cathode treatment is described below.

EXAMPLE

An entire graphite cathode, having the dimensions 650×450×3300 mm is impregnated with impregnating pitch. The impregnating pitch is a coal pitch having a Mettler point of 95° C. and the amount of insoluble matter in the toluene is less than 6%. The pitch is preheated to a temperature of 200° C. in order for its viscosity to be less than 150 cP. The product is heated in an autoclave to a temperature of 200° C. Once the temperature has been reached, the autoclave is evacuated until a residual vacuum of less than 10 mm of mercury (760 mm of mercury=101,300 Pa) is obtained. The hot pitch is then introduced into the autoclave by suction. With the cathode immersed in the pitch, the pitch inlet valve is closed and gaseous nitrogen is injected into the autoclave at a pressure of 10 bar (1 bar=$10^5$ Pa). After pressurizing the autoclave for one hour, it is opened and a product is cooled.

Comparing the weights of the cathode before and after treatment allows a 19% weight gain to be calculated. A theoretical calculation based on the porosity of the product and the density of the impregnation pitch makes it possible to conclude that, with such an uptake, all of the pores in the cathode are filled with impregnant. Next, the product is fired in a reducing atmosphere at a temperature close to 1000° C. The firing operation causes the pores to open again, leaving part of the impregnant in them. The characteristics of the impregnated cathode are compared with that of the non-impregnated cathode:

| Graphite cathode | Non-impregnated | Impregnated | Variation (%) |
|---|---|---|---|
| Apparent density | 1.593 | 1.744 | +9.5 |
| Flexural strength (MPa) | 10.6 | 17.3 | +63.5 |

After firing, the weight gain is 9.5% and the increase in flexural strength is very great, which proves that the microcracks are plugged by the impregnating pitch and thus proves that there is good wetting of the impregnating pitch on the graphitized pitch.

As is apparent from the foregoing, the invention greatly improves the existing technique, by providing a graphite cathode of conventional structure whose electrical and thermal conductivity properties are completely maintained and whose wear is greatly limited compared with a conventional cathode.

As goes without saying, the invention is not limited to just the one embodiment of this cathode, nor to just the one method of implementation of the process, which are described above by way of examples; on the contrary, it encompasses all the variants thereof. Thus, in particular, it would be possible to subject a graphite block to several successive treatments, possibly using several different carbon-containing products, or to carry out a treatment only on one surface of the block, for example the surface corresponding to the ends of the cathode, without thereby departing from the scope of the invention. The creation of the vacuum, the pressurization or the complete immersion are not necessary if it is desired to carry out a treatment by dipping or a localized treatment of a predefined region of the cathode.

What is claimed is:

1. A method of making an impregnated graphite cathode for electrolysis of aluminum, comprising:

(a) forming a carbon-containing body;

(b) graphitizing said body at above 2400° C. to form a porous graphite body;

(c) heating at least one impregnant comprising at least one substance selected from the group consisting of coal pitches and petroleum pitches to an impregnant temperature sufficient to reduce its viscosity below 150 cP;

(d) impregnating at least a portion of the pores of said porous graphite body with said at least one heated impregnant; and (e) heating said impregnated body at a temperature below 1600° C. for a time sufficient to coke said substance.

2. The method of claim 1, wherein step (c) comprises heating said impregnant at a temperature of at least about 200° C.

3. The method of claim 1, further comprising heating said graphite body to at least said impregnant temperature before step (d).

4. The method of claim 1, further comprising cooling the impregnated body after step (d) and before step (e).

5. The method of claim 1, further comprising impregnating said body with a different impregnant after step (e).

6. The method of claim 1, wherein step (d) comprises impregnating only a portion of said porous graphite body.

7. A method of producing aluminum, comprising:

forming a cathode by the method of claim 1;

subjecting an aluminum containing substance to electrolysis between said cathode and an anode.

8. The method of claim 1, wherein step (d) forms pores with a lining of but not blocked with the coked substance.

9. A method of making an impregnated graphite cathode for electrolysis of aluminum, comprising:

(a) forming a carbon-containing body;

(b) graphitizing said body at above 2400° C. to form a porous graphite body;

(c) impregnating at least a portion of the pores of said porous graphite body with an impregnant comprising at least one carbon-containing substance;

(d) heating said impregnated body at a temperature below 1600° C. for a time sufficient to coke said substance;

(e) impregnating said impregnated body with at least one different impregnant.

10. The method of claim 9, wherein said different impregnant also comprises a carbon-containing substance.

11. The method of claim 9, wherein step (d) includes heating said impregnated body at a temperature above 1000° C.

12. The method of claim 9, wherein said carbon-containing substance comprises at least one member selected from the group consisting of coal pitches and petroleum pitches.

13. The method of claim 12, further comprising heating said carbon-containing impregnant to an impregnant temperature sufficient to reduce its viscosity below 150 cP before step (c).

14. The method of claim 9, wherein step (c) comprises impregnating only a portion of said porous graphite body.

15. A method of producing aluminum, comprising:

forming a cathode by the method of claim 9;

subjecting an aluminum containing substance to electrolysis between said cathode and an anode.

16. A method of making an impregnated graphite cathode for electrolysis of aluminum, comprising:

(a) forming a carbon-containing body;

(b) graphitizing said body at above 2400° C. to form a porous graphite body;

(c) selectively impregnating only a predetermined portion of said porous graphite body with an impregnant comprising at least one carbon-containing substance; and (d) heating said impregnated body at a temperature below 1600° C. for a time sufficient to coke said substance.

17. The method of claim 16, wherein said portion is only at ends of said porous graphite body.

18. The method of claim 16, wherein said portion is only one surface of said porous graphite body.

19. The method of claim 16, wherein step (c) is carried out by partial immersion of the porous graphite body in said impregnant.

20. The method of claim 16, comprising rendering impermeable at least one surface of the porous graphite body before step (c).

21. The method of claim 16, wherein said substance comprises at least one member selected from the group consisting of coal pitches and petroleum pitches.

22. The method of claim 21, wherein step (d) includes heating said impregnated body at a temperature above 1000° C.

23. The method of claim 21, further comprising heating said carbon-containing impregnant to an impregnant temperature sufficient to reduce its viscosity below 150 cP before step (c).

24. The method of claim 16, further comprising impregnating said body with a different impregnant after step (d).

25. A method of producing aluminum, comprising:

forming a cathode by the method of claim 16;

subjecting an aluminum containing substance to electrolysis between said cathode and an anode.

26. A method of making an impregnated graphite cathode for electrolysis of aluminum, comprising:

(a) forming a carbon-containing body;

(b) graphitizing said body at above 2400° C. to form a porous graphite body;

(c) heating at least one impregnant comprising at least one substance selected from the group consisting of coal pitches and petroleum pitches to an impregnant temperature of at least about 200° C.;

(d) impregnating at least a portion of the pores of said porous graphite body with said at least one heated impregnant; and (e) heating said impregnated body at a temperature below 1600° C. for a time sufficient to coke said substance.

27. The method of claim 26, wherein step (c) reduces the viscosity of said impregnant below 150 cP.

28. The method of claim 26, wherein step (d) forms pores with a lining of but not blocked with the coked substance.

29. A method of producing aluminum, comprising subjecting an aluminum containing bath to electrolysis between a cathode and an anode, wherein said cathode is an impregnated graphite cathode with improved erosion resistance made by the method of claim 26.

30. The method of claim 29, wherein products from the bath enter said pores but are kept separate from the graphite of the cathode during the electrolysis by the lining of the coked substance.

31. A method of making an impregnated graphite cathode with improved erosion resistance for electrolysis of aluminum, comprising:

(a) forming a carbon-containing body;

(b) graphitizing said body at above 2400° C. to form a porous graphite body;

(c) impregnating at least a portion of the pores of said porous graphite body with an impregnant having a viscosity that decreases with increased temperature and comprising at least one substance selected from the group consisting of coal pitches and petroleum pitches, under conditions that achieve good wetting of the pores of the graphite body with the substance; and (d) heating said impregnated body at a temperature below 1600° C. for a time sufficient to coke said substance in said pores to form pores with a lining of but not blocked with the coked substance.

32. The method of claim 31, wherein the heating of step (d) causes fully impregnated pores of the graphite body to open but remain lined with the coked substance.

33. The method of claim 31, further comprising preheating said porous graphite body and said impregnant before step (c) to ensure easy penetration of the impregnant into the pores.

34. The method of claim 33, wherein the pre-heated impregnant has a viscosity below 150 cP during step (c).

35. A method of producing aluminum, comprising subjecting an aluminum containing bath to electrolysis between a cathode and an anode, wherein said cathode is an impregnated graphite cathode with improved erosion resistance according to claim 33.

36. The method of claim 35, wherein products from the bath enter said pores but are kept separate from the graphite of the cathode during the electrolysis by the lining of the coked substance.

37. The method of claim 33, wherein said porous graphite body and said impregnant are pre-heated to at least about 200° C.

38. A method of producing aluminum, comprising subjecting an aluminum containing bath to electrolysis between a cathode and an anode, wherein said cathode is an impregnated graphite cathode with improved erosion resistance made by the method of claim 31.

39. The method of claim 38, wherein products from the bath enter said pores but are kept separate from the graphite of the cathode during the electrolysis by the lining of the coked substance.

40. A method of making an impregnated graphite cathode with improved erosion resistance for electrolysis of aluminum, comprising:

(a) forming a carbon-containing body;

(b) graphitizing said body at above 2400° C. to form a porous graphite body;

(c) impregnating at least a portion of the pores of said porous graphite body with an impregnant consisting essentially of at least one substance selected from the group consisting of coal pitches and petroleum pitches, under conditions that achieve good wetting of the pores of the graphite body with the substance; and (d) heating said impregnated body at a temperature below 1600° C. for a time sufficient to coke said substance in said pores to form pores with a lining of but not blocked with the coked substance.

41. A method of producing aluminum, comprising subjecting an aluminum containing bath to electrolysis between a cathode and an anode, wherein said cathode is an impregnated graphite cathode with improved erosion resistance according to claim 46.

42. The method of claim 41, wherein products from the bath enter said pores but are kept separate from the graphite of the cathode during the electrolysis by the lining of the coked substance.

43. A method of producing aluminum, comprising subjecting an aluminum containing bath to electrolysis between a cathode and an anode, wherein said cathode is an impregnated graphite cathode with improved erosion resistance, comprising a porous graphite body, formed by graphitizing a carbon-containing body at above 2400° C., said porous graphite body having pores with a lining of but not blocked with at least one coked substance, selected from the group consisting of coked coal pitches and coked petroleum pitches, wherein said lining has been heated at a temperature below 1600° C.

44. The method of claim 43, wherein products from the bath enter said pores but are kept separate from the graphite of the cathode during the electrolysis by the lining of the coked substance.

* * * * *